350-330 SR
XR 3,978,653
TX 3102T

United States
Burke et al.

[1] 3,978,653
[5] Sept. 7, 1976

[54] SOLDERLESS CONTACT FOR ELECTRONIC WATCH

[75] Inventors: Roger A. Burke, Laguna Beach; Bela Somogyi, Costa Mesa, both of Calif.

[73] Assignee: Hughes Aircraft Company, Culver City, Calif.

[22] Filed: June 27, 1975

[21] Appl. No.: 591,219

[52] U.S. Cl. ..... 58/23 R; 58/50 R; 339/256 R

[51] Int. Cl.[2] ..... G04C 3/00; G04B 19/30; H01R 11/22

[58] Field of Search ..... 58/23 R, 50 R, 55; 339/256 R

[56] References Cited

UNITED STATES PATENTS 3,846,971 11/1974 Ho et al. ..... 58/50 R

*Primary Examiner*—Edith Simmons Jackmon
*Attorney, Agent, or Firm*—Allen A. Dicke, Jr.; William H. MacAllister

[57] ABSTRACT

Electronic substrate of the electronic watch is the principal carrier of the electronics and electrical interconnections. Top and bottom spacers embrace the substrate. Contact springs press onto and clamp on the substrate and contact the circuitry on the substrate. The springs are contactable for input to the watch electronics.

7 Claims, 7 Drawing Figures

Fig. 1.
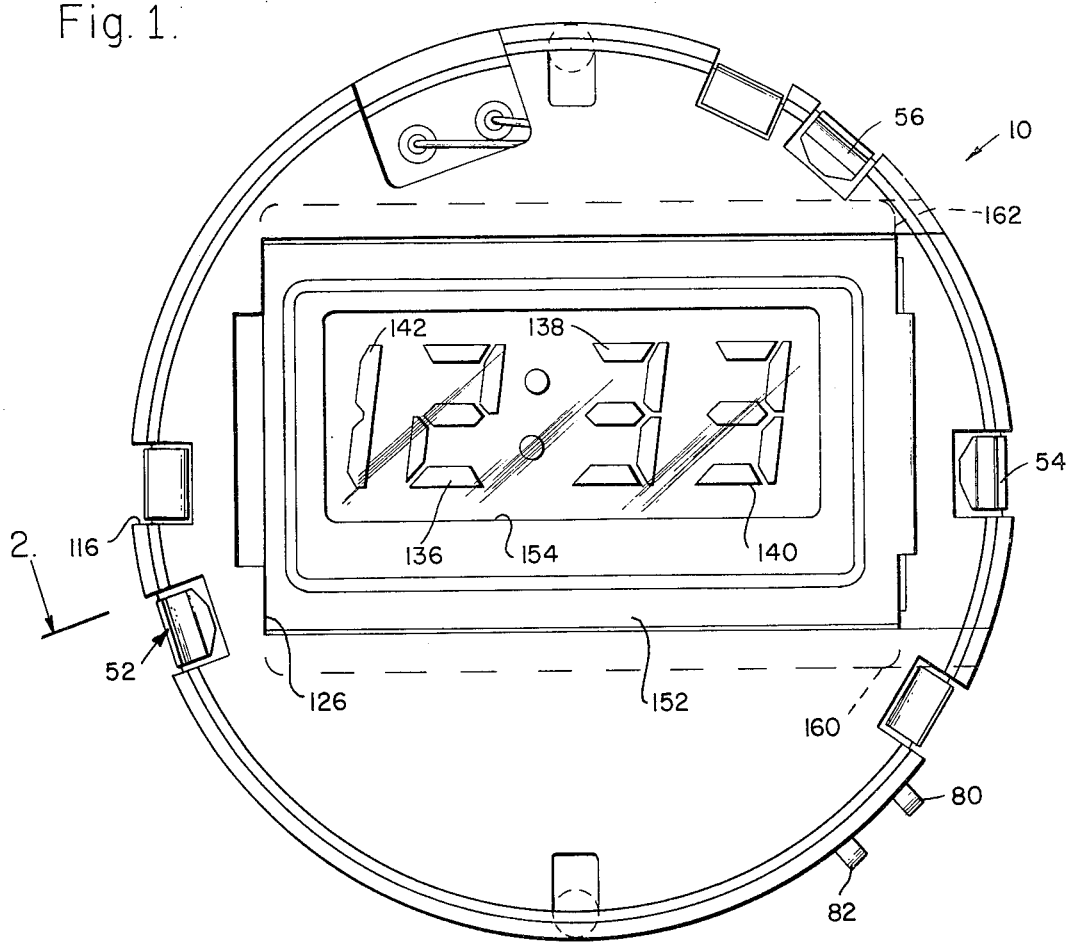
Fig. 5.
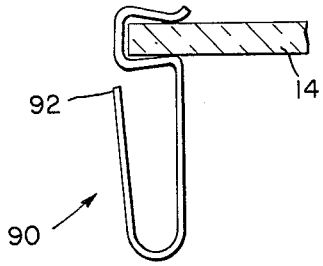
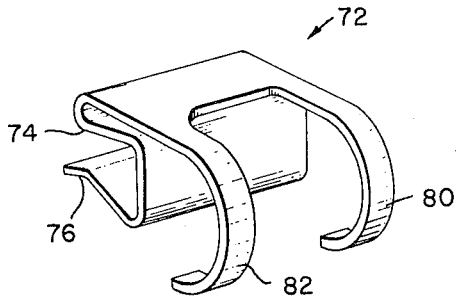
Fig. 7.

Fig. 3.
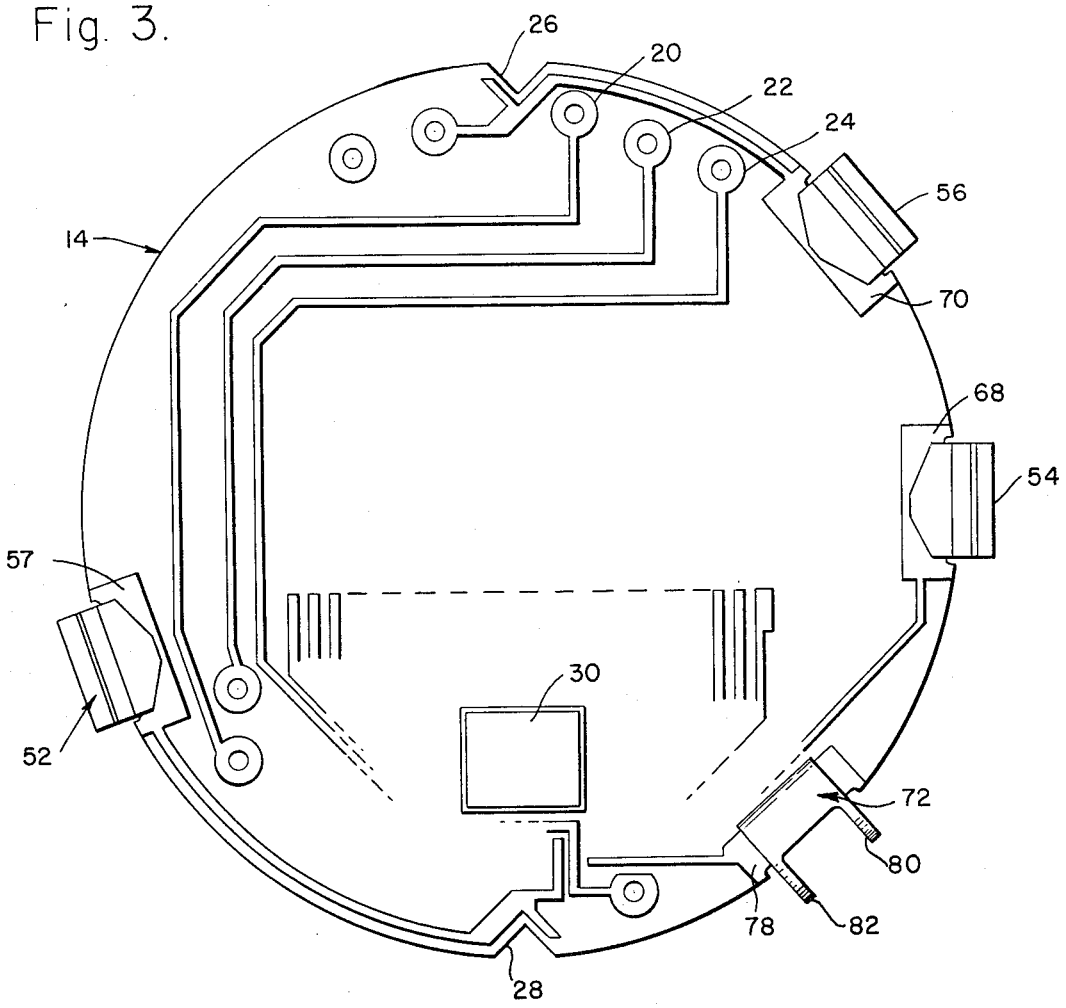
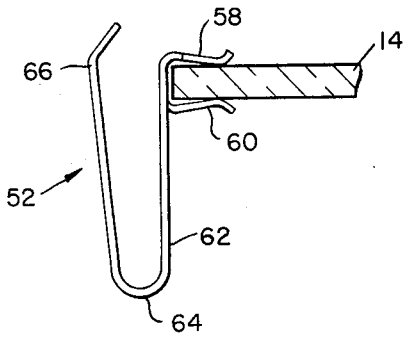
Fig. 4.
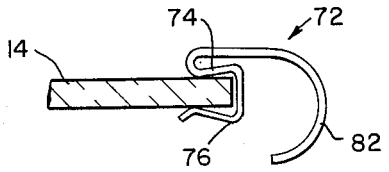
Fig. 6.

SOLDERLESS CONTACT FOR ELECTRONIC WATCH

CROSS REFERENCE

Commonly assigned Pat. application Ser. No. 563,927 filed Mar. 31, 1975, by Roger A. Burke, Rudolph L. Zurcher and Bela Somogyi for Electronic Watch Construction discloses the subject matter claimed herein and is relied upon as a related application.

BACKGROUND OF THE INVENTION

This invention relates to the construction of an electronic watch, and particularly to the manner in which the circuitry on a watch substrate is connected and controlled within a watch case.

An electronic watch is one in which time increments are generated at a frequency in the order of kilocycles to megacycles per second, with dividers and memories for electronic time information processing. Readout is conveniently digital so that there are usually no movable mechanical parts except for switches to control the electronics. In recent years, there have been many inventions in electronic watches and many of the patents describe at least a portion of the physical constructions which interrelate the physical and electronic components. Pertinent background patents include McCullough et al U.S. Pat. No. 3,759,031, Perkins et al U.S. Pat. No. 3,784,725, Doss U.S. Pat. No. 3,846,972, Yamazaki U.S. Pat. No. 3,800,523 and Zurcher et al U.S. Pat. No. 3,838,567. These patents are just a few in the large body of prior art in the electronic watch and related field and are offered as examples of patents which disclose some of the physical structure of electronic watch construction.

In assemblying an electronic watch the electronics must be supported and protected and must be related to other components for physical and electrical interconnections. The clamping, attachment, interconnection, and switching of the watch structure is a field in which concepts relating to economy reliability and serviceability must be applied. The prior art does not indicate the manner in which various design features should be optimized.

SUMMARY OF THE INVENTION

In order to aid in the understanding of this invention it can be stated in essentially summary form that it is directed to an electronic watch construction, and particularly a construction in which an electronic substrate has a contact spring clamped over the edge thereof for contact for control of the watch electronics.

It is thus an object of this invention to provide an electronic watch construction which is convenient and economic to manufacture and assemble and provides a reliable and trouble free electronic watch.

It is a further object to provide an electronic watch wherein electric connections to the substrate are accomplished at least in part by contact springs which resiliently engage over the edge of the substrate and engage onto an electric conductor thereon so that contact springs may be snapped in placed for convenient assembly and repair.

Other objects and advantages of this invention will become apparent from the study of the following portion of the specification, the claims and the attached drawings.

BRIEF DESCRIPTION OF THE DRAWINGS

FIG. 1 is a top plan view of a watch module having the solderless contact for electronic watch of this invention.

FIG. 3 is a top plan view of the watch substrate.

FIG. 4 is a side elevational view of one of the contact springs clamped on the edge of the substrate carrying its contact springs.

FIG. 5 is a similar view of another spring for the same purpose and applicable when the contact pushbutton is below the substrate.

FIG. 6 is an elevational view of the ground contact spring clamped on the edge of the substrate.

FIG. 7 is an enlarged isometric view of the spring shown in FIG. 6.

DESCRIPTION

Figure 2:
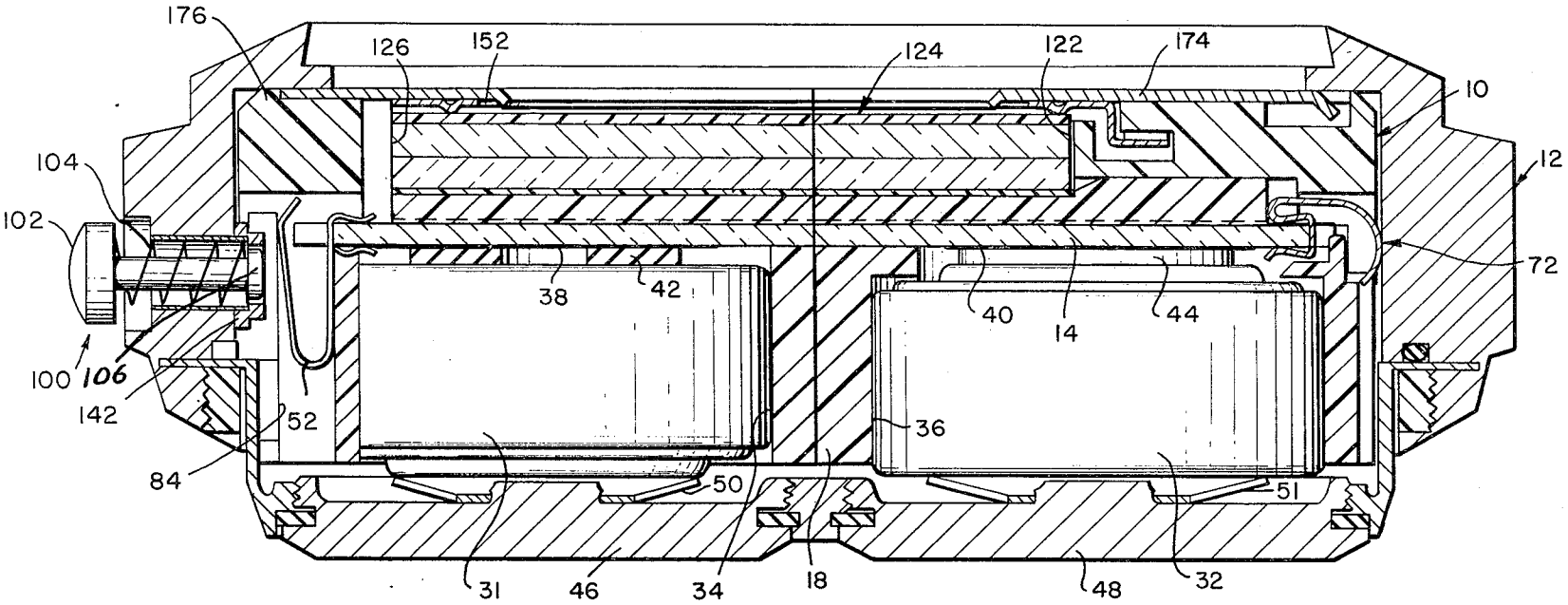
FIG. 2 is a section through the watch module and its case taken generally along line 2—2 FIG. 1.

FIG. 2 shows the watch module structure 10 of this invention in watch case 12. Watch structure 10 includes substrate 14 clamped between top spacer 16 and bottom spacer 18.

As seen in FIG. 3, substrate 14 is the principal carrier of the electronics and electrical interconnections of the electronic watch mechanism. Substrate 14 is preferrably a ceramic substrate for its dimensional stability, rigidity and insulation value. Printed circuitry is printed on the top as shown in FIG. 3. The quartz crystal of the watch is positioned below substrate 14 and is electrically connected at pads 20, 22 and 24 which are part of the integrated circuitry on the top of substrate 14. In order to properly locate substrate 14 during its manufacture, and during the printed circuit processing and attachment of elements, notches 26 and 28 are formed at edges for location of the substrate. These locating V notches are employed during the entire manufacturing process for positive location so that parts on the substrate are positively connected. Integrated circuit chip 30 is secured to the top of the substrate and is interconnected by wire bonds to the printed circuitry on the substrate.

In order to be effective, the substrate circuitry must be supplied with power, must be controllable and must have a useful display. Power is supplied by batteries 31 and 32, see FIG. 2, which are respectively positioned in battery pockets 34 and 36 in bottom spacer 18. Battery pads 38 and 40 are formed on the back of the substrate and are connected to the front by the usual vias. Elastomeric conductors 42 and 44 in the form of perforated discs are positioned between the batteries and the battery pads. These elastomeric conductors are used for electrical connection and spreading mechanical shock from the battery across a larger area of the substrate to help protect the substrate against damage. For further reference to this construction, attention is called to Patent application Ser. No. 563,927 filed Mar. 31, 1975, by Roger A. Burke, Rudolf F. Zurcher and Bela Somogyi for Electronic Watch Construction, the entire disclosure of which is incorporated herein by this reference. The batteries are accessible for replacement through battery hatches 46 and 48 through the back of the case. Battery contact force can be maintained by battery springs 50 and 51, but if the elastomeric conductors 42 and 44 are arranged for sufficient resilient displacement, the battery springs can be eliminated.

In the control of the electronics on the substrate, switching is required. Switching is for the purpose of choosing a particular display, for example choosing an hours-minutes time display, a seconds display or a month-day display, whether or not the optical display device is a light emitting diode or a liquid crystal display. Also, control is required for the setting of the watch. Electric signals to the electronics in the watch are accomplished by manually operable electric switches. The section through the watch case in FIG. 2 is a section through the push button switch 100 in association with J shaped contact spring 52. Similar push button switches are in association with J shaped contact springs 54 and 56. When one of the J shaped contact springs is in association with circuitry employed in resetting the horological memory, it may be recessed so that it is not inadvertently depressed, in order to maintain the memory. The push buttons connect the potential of the case to each J shaped contact spring 52, 54, 56, each of which is connected to the electronic circuitry.

FIG. 4 illustrates contact spring 52 in more detail. Contact spring 52 is clamped over the edge of substrate 14 onto contact pad 57 which is connected to the watch circuitry. Clamp jaws 58 and 60 are formed on the top of downwardly extending spring leg 62 which is connected by bend 64 to the upwardly extending J shaped contact leg 66 of contact spring 52. It is the upper part of contact leg 56 which is engaged by the push button to connect the case potential to the contact pads 56 to effect control of the electronics.

Each of the contact springs 52 is engaged in a T slot in the lower spacer block. As is seen in FIG. 2, J shaped contact spring 52 is engaged in a T slot which has inwardly facing shoulders 84 to limit outward extension of the free leg. In this way the free leg is controlled so that the push button contacts it at the same point.

FIG. 2 illustrates push button 100 which is slidably mounted in case 12. Button pad 102 is manually acessible and is urged toward the extended position by spring 104. Push button contact 106 is thus spring urged to a position where the contact 106 is between the sidewalls of the T slot and does not extend through to shoulder 84 and thus push button contact 106 is out of contact with the free leg 66 of J shaped contact spring 52. Manual depression of button 102 moves contact 106 to be extended into electrical contact with the free end of J shaped spring 52. The free end can deflect away from shoulder 84 so that no excessive manual stress is applied to the substrate. As is seen in FIG. 2, the case potential is intermediate the potential of battery pads 38 and 40. When the push button engages the case voltage onto contact leg 66, pad 57 is connected to a potential between the potential of pads 38 and 40. This potential is fed to the integrated circuit chip 30 as input information for controlling the logic. Similarly, J shaped contact springs 54 and 56 are respectively connected on contact pads 68 and 70 which are also connected to the substrate circuitry. Manually operable push buttons are positioned in the case to contact each of these J shaped contact springs for various control modes of the electronics. The ground spring 72 and the J shaped contact springs can also serve to interconnect the contact circuitry spring on the top and bottom of the substrate.

FIG. 5 shows a similar J shaped contact spring 90 which clamps on the edge of substrate 14 in watch structures where the substrate is higher than the push button. Thus the free end 92 of J shaped contact spring 90 is below the substrate. However, its position is controlled by the slot walls 84, the same as for J shaped contact spring 52.

Ground spring 72, see FIGS. 2, 3, 6 and 7 has upper and lower clamp jaws 74 and 76 for clamping over the edges of the substrate 14 as is shown in FIGS. 6 and 7, and for engaging on contact pad 78 on the substrate. Contact pad 78 is also connected to the electronics. Ground spring 72 has contact spring fingers 80 and 82 for resilient engagement on the inside of the watch case, see FIG. 2. In this way, the intermediate voltage of the watch case is permanently connected with contact pad 78 to supply that potential to the circuitry on the substrate. Ground spring 72, like J shaped contact springs 52, 54 and 56 is formed of resilient metal for proper clamping and engagement and making of contact with the contact pads on the substrate and for making proper contact with the push buttons in the case, as required. An alternative shape for ground spring 72 is one where the spring clamps over the edge of the substrate but contacts the side of the battery instead of the case wall.

All cross referenced material in this specification is incorporated herein in its entirety by this reference.

This invention having been described in its preferred embodiment, it is clear that it is susceptible to numerous modifications and embodiments within the ability of those skilled in the art, and without the exercise of the inventive skill. Accordingly the scope of this invention is defined by the scope of the following claims.

What is claimed is:

1. An electronic watch construction comprising:

a substrate having a face and having edges, said substrate carrying electronic watch components on the face thereof, at least one contact pad on said substrate adjacent the edge thereof, said contact pad being connected to said electronic circuitry;

a contact spring having clamp jaws engaged over the edge of said substrate and clamping on said contact pad for electrical contact between said spring and said contact pad, said spring having a free end away from said jaws of said spring, said free end of said spring being contactable at case potential when said electronic watch structure is positioned in a watch case for connecting watchcase potential to said pad.

2. The watch structure of claim 1 wherein said spring is selectively engageable at watchcase potential.

3. The watch structure of claim 2 wherein there are a plurality of springs respectively clamped on a plurality of contact pads adjacent the edge of said substrate, said plurality of springs each being selectively contactable with case potential.

4. The watch structure of claim 3 wherein there is an additional contact spring clamped over the edge of said substrate on a contact pad, said additional contact spring being continuously engaged at case potential when said watch structure is positioned in watchcase.

5. An electronic watch structure comprising:

a substrate having a face and having edges, said substrate carrying electronic watch components on the face thereof, at least one contact pad on said substrate adjacent the edge thereof, said contact pad being connected to said electronic circuitry;

a contact spring having clamp jaws engaged over the edge of said substrate and clamping on said contact pad for electrical contact between said spring and said contact pad, said spring having a free end away from said jaws of said spring, said contact spring being J shaped with a downwardly extending spring leg extending away from said substrate;

a spacer block positioned against said substrate, said spacer block having a periphery and having an opening therein with a shoulder facing away from said periphery and a connecting opening between said periphery and said opening, said free end of said spring lying against said shoulder when said contact spring is unactuated to define an accurate position of said free end, so that said free end of said spring is selectively contactable at case potential when said electronic watch structure is positioned in a watchcase for connecting watchcase potential to said pad.

6. The watch structure of claim 5 wherein said spring opening and said connecting opening comprise a T slot.

7. An electronic watch structure comprising:

a substrate having a face and having edges, said substrate carrying electronic watch components on the face thereof, at least one contact pad on said substrate adjacent the edge thereof, said contact pad being connected to said electronic circuitry;

a contact spring having claim jaws engaged over the edge of said substrate and clamping on said contact pad for electrical contact between said spring and said contact pad, said spring having a free end away from said jaws of said spring, said free end of said spring being in contact with metallic structure at watchcase potential when said electronic watch structure is positioned in a watchcase for connecting watchcase potential to said pad.

* * * * *